US005928825A

United States Patent [19]

Eguchi et al.

[11] Patent Number: 5,928,825

[45] Date of Patent: Jul. 27, 1999

[54] TONER FOR DEVELOPING ELECTROSTATIC LATENT IMAGES

[75] Inventors: Atsuhiko Eguchi, Minami Ashigara; Hideki Sakai; Takeo Kigami, both of Kuga-gun; Chiaki Suzuki; Takayoshi Aoki, both of Minami Ashigara, all of Japan

[73] Assignees: Fuji Xerox Co., Ltd.; Mitsui Chemicals, Inc., both of Tokyo, Japan

[21] Appl. No.: 08/668,447

[22] Filed: Jun. 21, 1996

[30] Foreign Application Priority Data

Jun. 26, 1995 [JP] Japan ..... 7-180592

[51] Int. Cl.[6] ..... G03G 9/097

[52] U.S. Cl. ..... 430/110; 430/109; 430/111

[58] Field of Search ..... 430/109, 110, 430/111

[56] References Cited

U.S. PATENT DOCUMENTS

| | | | |
|---|---|---|---|
| 5,518,848 | 5/1996 | Ito et al. | 430/109 |
| 5,650,254 | 7/1997 | Eguchi et al. | 430/110 |

FOREIGN PATENT DOCUMENTS

| | | | |
|---|---|---|---|
| 0421410 | 4/1991 | European Pat. Off. | 430/109 |
| B-52-3304 | 1/1977 | Japan . | |
| B-52-3305 | 1/1977 | Japan . | |
| B-57-52574 | 11/1982 | Japan . | |
| A-58-59455 | 4/1983 | Japan . | |
| A-58-63947 | 4/1983 | Japan . | |
| B-58-58664 | 12/1983 | Japan . | |
| A-59-177570 | 10/1984 | Japan . | |
| A-60-3644 | 1/1985 | Japan . | |
| A-60-457 | 1/1985 | Japan . | |
| A-60-93456 | 5/1985 | Japan . | |
| A-60-93457 | 5/1985 | Japan . | |
| A-60-151650 | 8/1985 | Japan . | |
| A-61-236804 | 10/1986 | Japan . | |
| A-62-148508 | 7/1987 | Japan . | |
| 63-191817 | 8/1988 | Japan | 430/110 |
| A-63-191817 | 8/1988 | Japan . | |

OTHER PUBLICATIONS

Derwent Abstract of JP 63–191817: No. 88–261827/37 (1988).

Patent & Trademark Office English–Language Translation of JP 63–191817 (Pub Aug. 1988).

Chiang, R *Journal of Polymer Science,* vol. XXXVI pp. 91–103 (1959).

Japanese Industrial Standard JIS K2207, English–Language Version, Published by Japanese Standards Association (Nov. 1996).

*Primary Examiner*—Janis L. Dote

*Attorney, Agent, or Firm*—Oliff & Berridge, PLC

[57] ABSTRACT

A toner for developing electrostatic latent images containing a binder resin, a colorant, and a lubricant, wherein the lubricant comprises a modified polyethylene wax which is obtained by homopolymerizing ethylene or copolymerizing ethylene and an α-olefin having 3 to 10 carbon atoms in the presence of a metallocene catalyst and modifying the resulting homo- or copolymer by grafting thereto a styrene monomer and/or an unsaturated carboxylic acid monomer, the lubricant having a hexane extraction of not more than 65% by weight. The toner exhibits release properties at a lower temperature and thereby has satisfactory anti-offset properties without impairing powder fluidity and anti-blocking properties. It provides a toner image resistant against scratches by a peeling claw of a fixing roll part and against rub-of.

6 Claims, No Drawings

TONER FOR DEVELOPING ELECTROSTATIC LATENT IMAGES

FIELD OF THE INVENTION

This invention relates to a toner for dry process development of an electrostatic latent image in electrophotography, electrostatic recording, and the like.

BACKGROUND OF THE INVENTION

An electrophotographic process comprises forming an electrostatic latent image on a photoreceptor made of a photoconductive substance, developing the latent image with a toner by, for example, magnetic brush development, transferring the toner image on the photoreceptor to a transfer material, such as paper or a plastic film, and fixing the transferred toner image under heat or pressure or with a solvent to provide a permanent image.

For fixing a toner image, heat-fusing methods have been mostly used. The heat-fusing methods are divided into a contact system and a non-contact system. In recent years, a contact system using a heated roll has been widely used in copying or printing equipment for business use because of its high thermal efficiency and applicability to high-speed fixing.

However, the conventional heated roll fixing method tends to involve adhesion of a toner to a heated roll, which causes stains on the next copy, called an offset phenomenon. Offset is very likely to occur particularly when a quantity of heat applied per unit time is increased to cope with an increase in fixing speed in high-speed copying.

In the heated roll fixing system, a peeling claw is provided in the fixing roll part so as to prevent a transfer material, which is generally paper, from being wound around the roll after its passage. However, the increased stress imposed to the fixing part due to the recent speeding up of copying equipment sometimes causes such troubles as release failure or image missing at the front end of the copy due to scratches by the peeling claw.

Furthermore, where a photocopied image is used as an original from which another photocopy is taken, the original copy is rubbed with a paper-feed roller of an automatic paper-feed system and, as a result, the image of the original might be blurred or stained. In the case of double-side copying or multicolor copying, when a first toner image is fixed and then subjected to a second copying operation, the first toner image is rubbed with a paper-feed roller, also getting blurred or stained. Furthermore, where a plurality of copies as originals from which a copy is to be taken are set in a copying machine and automatically fed one by one, the back side of a copy rubs the image surface of the underlying copy to cause stains or blurs on the both, resulting in reduction of image quality.

On the other hand, binder resins essential to a toner for developing electrostatic latent images include styrene polymers, e.g., polystyrene, styrene-acrylate copolymer resins, polyester resins, epoxy resins, ketone resins, maleic acid resins, phenolic resins, terpene resins, polyvinyl butyral, and polybutyl methacrylate. Binder resins for toners are particularly required to have no adverse influence on chargeability, low hygroscopicity, good compatibility with carbon black used as a colorant, good grindability, and a moderately low softening point (around 100° C.) for satisfactory fixing properties. Even in using a binder resin satisfying these requirements, the above-mentioned problems cannot always be eliminated. It has therefore been demanded to develop an electrophotographic toner which has excellent release properties in heated roll fixing, causing no offset nor scratches by a peeling claw.

In order to overcome the above problems, it was proposed to add to a toner low-molecular weight polypropylene or polyethylene as a lubricant as disclosed in JP-B-52-3304, JP-B-52-3305, JP-B-57-52574, JP-B-58-58664, JP-A-58-59455, and JP-A-60-151650 (the term "JP-B" as used herein means an "examined published Japanese patent application", and the term "JP-A" as used herein means an "unexamined published Japanese patent application).

Use of the above-described lubricant produces some effects in improving release properties (i.e., anti-offset properties), preventing scratches by a peeling claw, and improving rub-off resistance of a fixed image but is not sufficient. Beside, the above-described polyolefin lubricant tends to form large domains in a toner due to its poor compatibility with the binder resin, resulting in serious deterioration in powder fluidity and cohesiveness of the toner.

It is known that the problem arising from the poor compatibility of the polyolefin lubricants with the toner binder resin can be solved by using a polyolefin-grafted polymer (see JP-A-60-457, JP-A-60-93456, JP-A-60-93457) or a modified polyolefin (see JP-A-58-63947, JP-A-59-177570, JP-A-60-3644, JP-A-62-148508, JP-A-63-191817). These methods are effective to improve dispersibility of a polyolefin lubricant thereby to prevent deterioration of the powder fluidity and cohesiveness of the toner to some extent but, in turn, impair the effect of improving release properties as essentially aimed at.

SUMMARY OF THE INVENTION

An object of the present invention is to provide a toner for developing electrostatic latent images which exhibits release properties at a lower temperature and thereby has satisfactory anti-offset properties, excellent powder fluidity, and undergoes no blocking phenomenon under high temperature and high humidity.

Another object of the present invention is to provide a toner for developing electrostatic latent images which provides a toner image resistant against scratches by a peeling claw of a fixing roll part and also against rub-off.

As a result of extensive investigations, the present inventors have found that the above-problems associated with a conventional dry process toner essentially comprising a binder resin, a colorant, and a lubricant can be solved by using, as a lubricant, a graft-modified polyolefin prepared from a specific polyolefin which is obtained by polymerization in the presence of a metallocene catalyst, and reached the invention based on this finding.

The present invention relates to a toner for developing electrostatic latent images containing a binder resin, a colorant, and a lubricant, wherein the lubricant comprises a modified polyethylene wax which is obtained by homopolymerizing ethylene or copolymerizing ethylene and an α-olefin having 3 to 10 carbon atoms in the presence of a metallocene catalyst and modifying the resulting homo- or copolymer by grafting thereto a styrene monomer and/or an unsaturated carboxylic acid monomer, the lubricant having a hexane extraction of not more than 65% by weight.

DETAILED DESCRIPTION OF THE INVENTION

The lubricant used in the present invention is a graft-modified ethylene homopolymer or a graft-modified ethylene copolymer comprising ethylene and an α-olefin having 3 to 10 carbon atoms, which may be substituted, in which the ethylene homo- or copolymer is obtained by polymerization in the presence of a metallocene catalyst.

The metallocene catalyst is not particularly limited in kind. Useful metallocene catalysts include catalyst compositions comprised of (A) a compound of a transition metal selected from the elements belonging to groups IVb, Vb and VIb of the Periodic Table and (B) a cocatalyst. Suitable transition metal compounds (A) include those represented by formula (I):

$$ML_x \quad (I)$$

wherein M represents a transition metal atom selected from the group IV elements, e.g., zirconium, titanium or hafnium; x represents the valence of the transition metal M, indicating the number of L; and L represents a ligand or group coordinating to the transition metal M, at least one of which is a ligand having a cyclopentadienyl skeleton, such as a cyclopentadienyl ligand or an indenyl ligand, with the other L's being a group or atom selected from the group consisting of a hydrocarbon group having 1 to 12 carbon atoms, an alkoxy group, an aryloxy group, a trialkylsilyl group, a group $SO_3R^1$, wherein $R^1$ represents a hydrocarbon group having 1 to 8 carbon atoms which may be substituted with a halogen atom, etc., a halogen atom, and a hydrogen atom.

Where the compound of formula (I) contains a plurality of ligands having a cyclopentadienyl skeleton, two of them may be connected to each other via an alkylene group (e.g., ethylene or propylene), an isopropylidene group, a substituted alkylene group (e.g., diphenylmethylene), a silylene group, or a substituted silylene group (e.g., dimethylsilylene or diphenylsilylene).

Specific examples of the transition metal compounds of formula (I) are:

bis(cyclopentadienyl)zirconium dichloride,
bis(methylcyclopentadienyl)zirconium dichloride,
bis(ethylcyclopentadienyl)zirconium dichloride,
bis(n-propylcyclopentadienyl)zirconium dichloride,
bis(n-butylcyclopentadienyl)zirconium dichloride,
bis(n-hexylcyclopentadienyl)zirconium dichloride,
bis(methyl-n-propylcyclopentadienyl)zirconium dichloride,
bis(methyl-n-butylcyclopentadienyl)zirconium dichloride,
bis (dimethyl-n-butylcyclopentadienyl) zirconium dichloride,
bis(n-butylcyclopentadienyl)zirconium dibromide,
bis(n-butylcyclopentadienyl)zirconium methoxychloride,
bis(n-butylcyclopentadienyl)zirconium ethoxychloride,
bis(n-butylcyclopentadienyl)zirconium butoxychloride,
bis(n-butylcyclopentadienyl)zirconium diethoxide,
bis(n-butylcyclopentadienyl)methylzirconium chloride,
bis(n-butylcyclopentadienyl)dimethylzirconium,
bis(n-butylcyclopentadienyl)benzylzirconium chloride,
bis(n-butylcyclopentadienyl)dibenzylzirconium,
bis(n-butylcyclopentadienyl)phenylzirconium chloride,
bis(n-butylcyclopentadienyl)zirconium hydride chloride,
ethylenebis(indenyl)dimethylzirconium,
ethylenebis(indenyl)diethylzirconium,
ethylenebis(indenyl)diphenylzirconium,
ethylenebis(indenyl)methylzirconium monochloride,
ethylenebis(indenyl)ethylzirconium monochloride,
ethylenebis(indenyl)methylzirconium monobromide,
ethylenebis(indenyl)zirconium dichloride,
ethylenebis(indenyl)zirconium dibromide,
ethylenebis[1-(4,5,6,7-tetrahydroindenyl)] dimethylzirconium,
ethylenebis[1-(4,5,6,7-tetrahydroindenyl)] methylzirconium monochloride,
ethylenebis[1-(4,5,6,7-tetrahydroindenyl)]zirconium dichloride,
ethylenebis[1-(4,5,6,7-tetrahydroindenyl)]zirconium dibromide,
ethylenebis[1-(4-methylindenyl)]zirconium dichloride,
ethylenebis[1-(5-methylindenyl)]zirconium dichloride,
ethylenebis[1-(6-methylindenyl)]zirconium dichloride,
ethylenebis[1-(7-methylindenyl)]zirconium dichloride,
ethylenebis[1-(5-methoxyindenyl)]zirconium dichloride,
ethylenebis[1-(2,3-dimethylindenyl)]zirconium dichloride,
ethylenebis[1-(4,7-dimethylindenyl)]zirconium dichloride,
ethylenebis[1-(4,7-dimethoxyindenyl)]zirconium dichloride,
isopropylidene(cyclopentadienyl-fluorenyl)zirconium dichloride,
isopropylidene(cyclopentadienyl-2,7-di-t-butylfluorenyl) zirconium dichloride,
isopropylidene(cyclopentadienyl-methylcyclopentadienyl)zirconium dichloride,
dimethylsilylenebis(cyclopentadienyl)zirconium dichloride,
dimethylsilylenebis(methylcyclopentadienyl)zirconium dichloride,
dimethylsilylenebis(dimethylcyclopentadienyl)zirconium dichloride,
dimethylsilylenebis(trimethylcyclopentadienyl) zirconium dichloride,
dimethylsilylenebis(indenyl)zirconium dichloride, and
diphenylsilylenebis(indenyl)zirconium dichloride.

In the compounds listed above, the disubstituted cyclopentadienyl ring includes a 1,2-substituted ring and a 1,3-substituted ring, and the trisubstituted cyclopentadienyl ring includes a 1,2,3-substituted ring and a 1,2,4-substituted ring. Titanium or hafnium compounds corresponding to the above-listed zirconium compounds are also included in useful transition metal compounds.

As cocatalyst (B), conventional compounds can be used with no particular limitation. An aluminoxane (B-1) and a compound capable of reacting with transition metal compound (A) to form an ionic complex (B-2) can be mentioned as typical examples of cocatalyst (B).

Aluminoxane (B-1) includes organoaluminum compounds represented by formula (II) or (III):

$$R^2_2Al-(OAl(R^2))_m-OAlR^2_2 \quad (II)$$

-continued

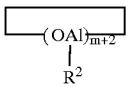

(III)

wherein $R^2$ represents a hydrocarbon group; and m represents an integer of 2 or greater.

The hydrocarbon group as $R^2$ includes methyl, ethyl, propyl, n-butyl, isobutyl, phenyl and phenylmethyl groups, with methyl, ethyl and isobutyl groups being preferred. m is an integer of 2 or greater, preferably 3 to 50, still preferably 3 to 40.

Aluminoxane (B-1) can be prepared by (1) a method comprising reacting a compound containing adsorption water or a salt containing water of crystallization, such as a magnesium hydrate or a copper sulfate hydrate, as suspended in a hydrocarbon medium with an organoaluminum compound, e.g., a trialkylaluminum, to obtain an aluminoxane as dissolved in the hydrocarbon or (2) a method comprising reacting an organoaluminum compound, e.g., a trialkylaluminum, directly with water, ice or steam in a hydrocarbon medium, such as benzene or toluene, to obtain an aluminoxane as dissolved in the hydrocarbon. The organoaluminum compound used includes trimethylaluminum, triethylaluminum, tripropylaluminum, tri-n-butylaluminum, triisobutylaluminum, tri-sec-butylaluminum, tri-t-butylaluminum, and triisopentylaluminum.

Compound (B-2), which is capable of reacting with transition metal compound (A) to form an ionic complex, includes compounds composed of a cation and an anion made up of a plurality of groups bonded to an element. Coordination complex compounds are particularly preferred. Examples of such compounds are trimethylammonium tetraphenylborate, triethylammonium tetraphenylborate, tri(n-butyl)ammonium tetraphenylborate, dimethylanilinium tetra(pentafluorophenyl)borate, triethylammonium tetra(pentafluorophenyl)borate, tri(n-butyl) ammonium tetra(pentafluorophenyl)borate, triethylammonium hexafluoroarsenate, ferrocenium tetraphenylborate, trityl tetraphenylborate, ferrocenium tetra (penetafluoropheyl)borate, methylferrocenium tetra (pentafluorophenyl)borate, decamethylferrocenium tetra (pentafluorophenyl)borate, silver tetra(pentafluorophenyl) borate, trityl tetra(pentafluorophenyl)borate, silver tetrafluoroborate, silver hexafluorophosphate, silver hexafluoroarsenate, silver perchlorate, silver hexafluoroantimonate, silver trifluoroacetate, silver trifluoromethanesulfonate, (N-benzyl-2-cyanopyridinium) tetra(pentafluorophenyl)borate, (N-benzyl-3-cyanopyridinium) tetra(pentafluorophenyl)borate, (N-benzyl-4-cyanopyridinium) tetra(pentafluorophenyl) borate, (N-methyl-2-cyanopyridinium) tetra (pentafluorophenyl)borate, (N-methyl-3-cyanopyridinium) tetra(pentafluorophenyl)borate, (N-methyl-4-cyanopyridinium) tetra(pentafluorophenyl)borate, trimethylammonium tetra(pentafluorophenyl)borate, trimethyl(m-trifluoromethylphenyl)ammonium tetra(pentafluorophenyl) borate, and benzylpyridinium tetra(pentafluorophenyl) borate.

If desired, cocatalyst (B) may be used in combination with an organoaluminum compound (C). The organoaluminum compound includes those represented by formula (IV):

$$R^3_nAlX_{3-n} \quad \text{(IV)}$$

wherein $R^3$ represents a hydrocarbon group having 1 to 12 carbon atoms; X represents a halogen atom or a hydrogen atom; and n represents an integer of 1 to 3.

The hydrocarbon group as represented by $R^3$ includes an alkyl group and an aryl group, such as methyl, ethyl, n-propyl, isopropyl, isobutyl, pentyl, hexyl, octyl, cyclopentyl, cyclohexyl, phenyl, and tolyl groups. Examples of the organoaluminum compound of formula (IV) include trialkylaluminum compounds, such as trimethylaluminum, triethylaluminum, triisopropylaluminum, triisobutylaluminum, trioctylaluminum, and tri-2-ethylhexylaluminum; alkenylaluminum compounds, such as isoprenylaluminum; dialkylaluminum halides, such as dimethylaluminum chloride, diethylaluminum chloride, diisopropylaluminum chloride, diisobutylaluminum chloride, and dimethylaluminum bromide; alkylaluminum sesquihalides, such as methylaluminum sesquichloride, ethylaluminum sesquichloride, isopropylaluminum sesquichloride, butylaluminum sesquichloride, and ethylaluminum sesquibromide; alkylaluminum dihalides, such as methylaluminum dichloride, ethylaluminum dichloride, isopropylaluminum dichloride, and ethylaluminum dibromide; and alkylaluminum hydrides, such as diethylaluminum hydride and diisobutylaluminum hydride.

The polymerization reaction is carried out in the presence of a metallocene catalyst composition composed of transition metal compound (A), cocatalyst (B) and, if desired, organoaluminum compound (C) in a hydrocarbon solvent. Examples of suitable hydrocarbon solvents are aliphatic hydrocarbons, such as butane, isobutane, pentane, hexane, octane, decane, dodecane, hexadecane, and octadecane; alicyclic hydrocarbons, such as cyclopentane, methylcyclopentane, cyclohexane, and cyclooctane; aromatic hydrocarbons, such as benzene, toluene, and xylene; and petroleum fractions, such as gasoline, kerosine, and gas oil. The olefins used as a monomer can also serve as a hydrocarbon solvent. Of these hydrocarbon solvents preferred are aromatic hydrocarbons.

In carrying out polymerization of ethylene alone or in combination with an α-olefin having 3 to 10 carbon atoms according to solution polymerization, transition metal compound (A) is used in a concentration of $1\times10^{-8}$ to $1\times10^{-2}$ gram–atom/l, preferably $1\times10^{-7}$ to $1\times10^{-3}$ gram–atom/l, in terms of the transition metal atom. Aluminoxane (B-1) is used in a concentration of $1\times10^{-4}$ to $1\times10^{-1}$ gram–atom/l, preferably $1\times10^{-3}$ to $1\times10^{-2}$ gram–atom/l, in terms of aluminum atom. An atomic ratio of aluminum to the transition metal in the polymerization system is usually 4 to $10^7$, preferably 10 to $10^6$.

The molecular weight of the ethylene homo- or copolymer can be controlled through adjustment of the amount of hydrogen and/or the polymerization temperature. The polymerization temperature is usually 20° C. or higher, preferably 50 to 230° C. The amount of hydrogen fed to the polymerization system is usually 0.01 to 4 mol, preferably 0.05 to 2 mol, per mole of the monomer used in the polymerization.

The resulting ethylene homopolymer or copolymer (hereinafter inclusively referred to as a polyethylene wax) preferably has an intrinsic viscosity [η] of not more than 0.4 dl/g, more preferably from 0.005 to 0.35 dl/g, as measured in decalin at 135° C. The ethylene unit content in the ethylene copolymer is usually 80 mol % or more, preferably 85 mol % or more.

The polyethylene wax exhibits self-lubrication based on a high density and molecular linearity and therefore reduces abrasive damage on the surface of a fixed image and prevent stains and blurs due to rub-off. That is, the polyethylene wax forms a self-lubricating film on the surface of a fixed image after passage under a heated roll to fully manifest its lubricating effect.

The polyethylene wax preferably has a molecular weight distribution of 1.05 to 1.8, more preferably 1.05 to 1.5, still more preferably 1.05 to 1.3 as expressed in terms of weight average molecular weight (Mw) to number average molecular weight (Mn) ratio (Mw/Mn) as measured by gel-permeation chromatography (GPC).

A molecular weight distribution of a polyethylene wax also has a great influence on the melting behavior of the polyethylene wax itself. A polyethylene wax is required to maintain a completely solid state under usual conditions and, when it passes through a pair of fixing rolls, to be completely melted at the vicinity of a temperature of a fixing roll within a very short time of passage to exert its lubricating effect. If the molecular weight distribution is controlled as described above, the temperature range in which a polyethylene wax completely melts is narrowed. In other words, the proportion of wax components which contribute to release from a fixing roll, i.e., the proportion of wax components which can melt at the temperature of a fixing roll, increases, which leads to improved efficiency in manifestation of the lubricating effect.

Metallocene catalysts are capable of providing polymers having a narrower molecular weight distribution than conventional catalyst systems. Therefore, there is no particular need to make the molecular weight distribution narrower by distillation, crystallization or washing with a solvent. If such an operation for narrowing the molecular weight distribution is necessary, it can be performed at good efficiency.

GPC for measurement of molecular weight distribution (Mw/Mn) of the polyethylene wax as referred to in the present invention was carried out on a chromatograph 150C manufactured by Waters, Co. using columns GMH-HT (height: 60 cm) and GMH-HTL (height: 60 cm), both manufactured by Tosoh Corp., connected in series. A 0.1 wt % solution of a sample in o-dichlorobenzene was passed through the columns at 140° C. at a flow rate of 1.0 ml/min.

The melt viscosity was measured with a Brookfield viscometer at 160° C.

If desired, the polyethylene wax as obtained by polymerization may be subjected to degassing in vacuo at the melting point or higher. Low-molecular weight components may be removed from the polyethylene wax by dissolving in a solvent, such as hexane or acetone. Furthermore, high-molecular weight components may be removed by dissolving the whole amount of the polyethylene wax in a solvent, followed by precipitation at a specific temperature.

A styrene monomer and/or an unsaturated carboxylic acid monomer is/are then grafted to the polyethylene wax for modification. A preferred graft ratio of the grafting monomer is 5 to 30 parts by weight per 100 parts by weight of the resulting graft-modified polymer. Within the preferred graft ratio, the lubricant of the present invention does not form large domains in a toner which would have adverse influences on powder fluidity, anti-blocking properties, and anti-caking properties, and does not show excessive dispersibility in a toner which would reduce the release effect of the lubricant and reduce the image strength against rubbing (rub-off resistance), thereby exhibiting satisfactory performance as a lubricant.

Specific but non-limiting examples of the styrene monomer as a graft-modifying monomer include styrene, α-methylstyrene, 2-methylstyrene, 3-methylstyrene, 4-methylstyrene, 2,5-dimethylstyrene, 3,4-dimethylstyrene, 2,4,6-trimethylstyrene, 2-ethylstyrene, 3-ethylstyrene, 4-butylstyrene, 4-sec-butylstyrene, 4-t-butylstyrene, 4-hexylstyrene, 4-nonylstyrene, 4-octylstyrene, 4-phenylstyrene, 4-decylstyrene, 4-dodecylstyrene, 2-chlorostyrene, 3-chlorostyrene, 4-chlorostyrene, 2,4-dichlorostyrene, 3,4-dichlorostyrene, 2-methoxystyrene, 4-methoxystyrene, and 4-ethoxystyrene.

Specific but non-limiting examples of the unsaturated carboxylic acid monomer as a graft-modifying monomer include acrylic esters, such as methyl acrylate, ethyl acrylate, butyl acrylate, sec-butyl acrylate, isobutyl acrylate, propyl acrylate, isopropyl acrylate, 2-octyl acrylate, dodecyl acrylate, stearyl acrylate, hexyl acrylate, isohexyl acrylate, phenyl acrylate, 2-chlorophenyl acrylate, diethylaminoethyl acrylate, 3-methoxybutyl acrylate, diethylene glycol ethyl ether acrylate, 2,2,2-trifluoroethyl acrylate; methacrylic esters, such as methyl methacrylate, ethyl methacrylate, butyl methacrylate, sec-butyl methacrylate, isobutyl methacrylate, propyl methacrylate, isopropyl methacrylate, 2-octyl methacrylate, dodecyl methacrylate, stearyl methacrylate, hexyl methacrylate, decyl methacrylate, phenyl methacrylate, 2-chlorophenyl methacrylate, diethylaminoethyl methacrylate, 2-ethylhexyl methacrylate, and 2,2,2-trifluoroethyl methacrylate; maleic esters, such as ethyl maleate, propyl maleate, butyl maleate, diethyl maleate, dipropyl maleate, and dibutyl maleate; fumaric esters, such as ethyl fumarate, butyl fumarate, and dibutyl fumarate; and itaconic esters, such as ethyl itaconate, diethyl itaconate, and butyl itaconate.

The content of the resulting modified polyethylene wax is preferably 1 to 20% by weight, more preferably 3 to 10% by weight, based on the weight of the toner.

Modification of the polyethylene wax by graft copolymerization can be carried out by various known techniques. For example, a polyethylene wax and a styrene monomer or an unsaturated carboxylic acid monomer are heat-melted and mixed together in the presence of a radical initiator. In this case, the reaction temperature preferably ranges from 125 to 325° C. Useful radical initiators include peroxides, e.g., benzoyl peroxide, lauroyl peroxide, dicumyl peroxide, and di-t-butyl peroxide; and azo compounds, e.g., azobisisobutyronitrile.

The modified polyethylene wax should have a hexane extraction of not more than 65% by weight. Anti-blocking properties of the wax itself is improved by controlling the hexane extraction of the wax within the above range. When the modified polyethylene wax having a hexane extraction within the above range is incorporated into toner particles, the toner particles exhibits excellent fluidity without undergoing agglomeration under high temperatures and high humidity.

The modified polyethylene wax preferably has a melt viscosity of 15 to 250 cP at 160° C. Within this range of melt viscosity, the cohesive strength of the fixed image and the melt viscosity of the surface of the image immediately after passage under a heated roll are controlled appropriately. As a result, such troubles as scraping of the image with a peeling claw, release failure, and scratches by a peeling claw due to the excessive stress imposed on release are avoided.

The above-described advantage brought about by the use of a metallocene catalyst system works in favor of the melt viscosity control.

The hexane extraction as used herein was determined as follows. Two grams of a wax was placed in a cylinder of filter paper and subjected to extraction with n-hexane for 5 hours at the boiling point using a Soxhlet extractor. The hexane extraction is expressed as a percentage by weight of the amount of the remainder of the wax on the filter.

The binder resin for use in the toner of the present invention includes homo- or copolymers comprising a styrene monomer, such as styrene, chlorostyrene or vinylstyrene; a vinyl ester monomer, such as vinyl acetate, vinyl propionate, vinyl benzoate or vinyl butyrate; an α-methylene aliphatic monocarboxylic acid ester monomer, such as methyl acrylate, ethyl acrylate, butyl acrylate, dodecyl acrylate, octyl acrylate, phenyl acrylate, methyl methacrylate, ethyl methacrylate, butyl methacrylate, or dodecyl methacrylate; a vinyl ether monomer, such as vinyl methyl ether, vinyl ethyl ether, or vinyl butyl ether; or vinyl methyl ketone. In addition, polyester resins, polyurethane resins, epoxy resins, silicone resins, and polyamide resins may also be used. While not limiting, preferred among them are polystyrene, a styrene-alkyl acrylate copolymer, a styrene-alkylmethacrylate copolymer, a styrene-acrylonitrile copolymer, a styrene-butadiene copolymer, and a styrene-maleic anhydride copolymer.

The colorants for use in the toner of the present invention typically include dyes and pigments e.g., carbon black, nigrosine dyes, Aniline Blue, Calco Oil Blue, Chrome Yellow, Ultramarine Blue, Du Pont Oil Red, Quinoline Yellow, Methylene Blue chloride, Phthalocyanine Blue, Malachite Green oxalate, lamp black, Rose Bengale, C.I. Pigment Red 48:1, C.I. Pigment Red 122, C.I. Pigment Red 57:1, C.I. Pigment Yellow 97, C.I. Pigment Yellow 12, C.I. Pigment Blue 15:1, and C.I. Pigment Blue 15:3. In addition, magnetic materials, such as magnetite and ferrite, may also be added.

If desired, the toner of the invention may contain known additives, such as a charge control agent. Furthermore, fine particles of other inorganic compounds may be externally added to the toner. For example, colloidal silica fine powder may be added as a fluidity modifier.

The toner of the present invention may be a two-component toner, a one-component toner containing a magnetic material, or a capsule toner. The toner of the present invention is applicable to any dry process for electrostatic latent image development. It is usually suited to use in electrophotography and electrostatic recording.

Any conventional electrostatic latent image carrier, i.e., electrophotographic photoreceptor, may be used in the present invention. For example, a selenium-based photoreceptor, an organic photoreceptor, an amorphous silicon photoreceptor, etc. may be used with, if desired, an overcoating formed thereon.

The present invention will now be illustrated in greater detail with reference to Examples, but it should be understood that the invention is not deemed to be limited thereto. Unless otherwise indicated, all the parts are by weight.

Preparation of a polyethylene wax using a metallocene Catalyst

PREPARATION EXAMPLE A

In a continuous polymerization vessel were fed continuously 200 l/hr of purified hexane, 0.4 mol/hr, in terms of Al atom, of methylaluminoxane (produced by Tosoh Corp. and Akuzo Co., Ltd.), 0.2 mol/hr of trimethylaluminum, and 2 mmol/hr, in terms of Zr atom, of bis(n-butylcyclopentadienyl)zirconium dichloride, and ethylene and hydrogen were continuously fed to form a gas phase having a hydrogen to ethylene molar ratio ($H_2/C_2H_4$) of 0.40 and a total pressure of 30 kgf/cm$^2$. Polymerization was carried out at a temperature of 140° C. under normal pressure for a retention time of 0.5 hour to a polymer concentration of 90 g/l. To 1 l of the resulting polymer solution was added 5 l of methanol to precipitate the polymer, and the precipitate was collected by filtration and dried to recover the polymer having the following physical properties.

[η]: 0.08 dl/g

Mw/Mn: 1.30

Melt viscosity (160° C.): 12.0 cP

PREPARATION EXAMPLE B

A polymer having the following physical properties was prepared in the same manner as in Preparation Example A, except for changing the hydrogen to ethylene molar ratio ($H_2/C_2H_4$) of the gas phase to 0.50.

[η]: 0.06 dl/g

Mw/Mn: 1.20

Melt viscosity (160° C.): 7.7 cP

PREPARATION EXAMPLE C

In 2000 ml of hexane, 1200 g of a polyethylene wax of Preparation Example A was dissolved at 60° C. The resulting solution was then allowed to stand at 50° C. for 1 hour. After removing thus precipitated impurities by filtration, the filtrate was cooled to 25° C. The resulting precipitate was collected by filtration and then dried. The polymer obtained had the following physical properties.

Mw/Mn: 1.12

Melt viscosity (160° C.): 12.0 cP

PREPARATION EXAMPLE D

A polymer having the following physical properties was prepared in the same manner as in Preparation Example A, except for changing the polymerization temperature to 145° C.

[η]: 0.06 dl/g

Mw/Mn: 1.37

Melt viscosity (160° C): 10.0 cP

Preparation of graft-modified polyethylene waxes

PREPARATION EXAMPLE 1

A thousand grams of the polyethylene wax obtained in Preparation Example A were melted at 160° C., and 250 g of styrene and 21 g of di-t-butyl peroxide were added thereto dropwise through separate pipes over a period of 4 hours. After completion of the addition, the reaction mixture was allowed to further react at 160° C. for 1 hour. The reaction mixture was degassed in vacuo of 30 mmHg for 1 hour to remove the volatile matter to obtain a modified polyethylene wax having a melt viscosity of 28.5 cP at 160° C.

PREPARATION EXAMPLE 2

A modified polyethylene wax having a melt viscosity of 17.0 cP at 160° C. was prepared in the same manner as in Preparation Example 1, except for using 1000 g of the polyethylene wax of Preparation Example B.

PREPARATION EXAMPLE 3

A modified polyethylene wax having a melt viscosity of 20.5 cP at 160° C. was prepared in the same manner as in Preparation Example 1, except for replacing 250 g of styrene with a mixture of 125 g of styrene and 125 g of dibutyl fumarate.

PREPARATION EXAMPLE 4

A modified polyethylene wax having a melt viscosity of 20.0 cP at 160° C. was prepared in the same manner as in Preparation Example 1, except for replacing 250 g of styrene with a mixture of 125 g of styrene and 125 g of butyl methacrylate.

PREPARATION EXAMPLE 5

A modified polyethylene wax having a melt viscosity of 23.7 cP at 160° C. was prepared in the same manner as in Preparation Example 1, except for using 1000 g of a polyethylene wax of Preparation Example C.

PREPARATION EXAMPLE 6

A modified polyethylene wax having a melt viscosity of 22.0 cP at 160° C. was prepared in the same manner as in Preparation Example 1, except for using 1000 g of a polyethylene wax obtained by polymerization using a Zieglar catalyst (Mw/Mn: 2.20; melt viscosity: 10.0 cP at 160° C.).

PREPARATION EXAMPLE 7

A modified polyethylene wax having a melt viscosity of 12.0 cP at 160° C. was prepared in the same manner as in Preparation Example 1, except for using 1000 g of a polyethylene wax obtained by polymerization using a Zieglar catalyst (Mw/Mn: 1.30; density: melt viscosity: 12.0 cP at 160° C.), 20 g of styrene and 1.7 g of di-t-butyl peroxide.

PREPARATION EXAMPLE 8

A modified polyethylene wax having a melt viscosity of 130.0 cP at 160° C. was prepared in the same manner as in Preparation Example 7, except for replacing 20 g of styrene with a mixture of 125 g of styrene and 540 g of dibutyl fumarate.

PREPARATION EXAMPLE 9

A modified polypropylene wax having a melt viscosity of 250.0 cP at 160° C. was prepared in the same manner as in Preparation Example 1, except for using 1000 g of a polypropylene wax (Mw/Mn: 2.80; melt viscosity: 70.0 cP at 160° C.).

PREPARATION EXAMPLE 10

A modified polyethylene wax having a melt viscosity of 22.0 cP at 160° C. was prepared in the same manner as in Preparation Example 1, except for using 1000 g of a polyethylene wax of Preparation Example D.

PREPARATION EXAMPLE 11

A modified polyethylene wax having a melt viscosity of 16.0 cP at 160° C. was prepared in the same manner as in Preparation Example 10, except for replacing 250 g of styrene with a mixture of 125 g of styrene and 125 g of dibutyl fumarate.

EXAMPLE 1

| 1) Preparation of Toner | |
|---|---|
| Styrene-butyl acrylate copolymer (85/15) (Mw: $1.8 \times 10^5$) | 100 parts |
| Carbon black (R330, produced by Cabot G.L. Inc.) | 10 parts |
| Charge control agent (P-51, produced by Orient Kagaku Kogyo K.K.) | 2 parts |
| Modified polyethylene wax of Preparation Example 1 | 5 parts |

The above components were melt-kneaded in a Banbury mixer, cooled, finely ground in a jet mill, and classified by a classifier to obtain toner particles having an average particle size of 10 μm.

2) Preparation of Carrier

A ferrite carrier having an average particle size of 85 μm was used.

3) Preparation of Developer

Three parts of the toner and 97 parts of the carrier were mixed to prepare a developer.

EXAMPLE 2

A developer composition was prepared in the same manner as in Example 1 except for using the modified polyethylene wax prepared in Preparation Example 2 as a lubricant.

EXAMPLE 3

A developer composition was prepared in the same manner as in Example 1 except for using the modified polyethylene wax prepared in Preparation Example 3 as a lubricant.

EXAMPLE 4

A developer was prepared in the same manner as in Example 1 except for using the modified polyethylene wax prepared in Preparation Example 4 as a lubricant.

EXAMPLE 5

A developer was prepared in the same manner as in Example 1 except for using the modified polyethylene wax prepared in Preparation Example 5 as a lubricant.

COMPARATIVE EXAMPLE 1

A developer was prepared in the same manner as in Example 1 except for using, as a lubricant, a polyethylene wax having [η] of 0.13 dl/g, Mw/Mn of 2.60, and a melt viscosity (160° C.) of 85.0 cP.

COMPARATIVE EXAMPLE 2

A developer was prepared in the same manner as in Example 1 except for using, as a lubricant, a polypropylene wax having Mw/Mn of 2.80, and a melt viscosity (160° C.) of 70.0 cP.

COMPARATIVE EXAMPLE 3

A developer was prepared in the same manner as in Example 1 except for using the modified polyethylene wax prepared in Preparation Example 6 as a lubricant.

COMPARATIVE EXAMPLE 4

A developer was prepared in the same manner as in Example 1 except for using the modified polyethylene wax prepared in Preparation Example 7 as a lubricant.

COMPARATIVE EXAMPLE 5

A developer was prepared in the same manner as in Example 1 except for using the modified polyethylene wax prepared in Preparation Example 8 as a lubricant.

COMPARATIVE EXAMPLE 6

A developer was prepared in the same manner as in Example 1 except for using the modified polypropylene wax prepared in Preparation Example 9 as a lubricant.

COMPARATIVE EXAMPLE 7

A developer was prepared in the same manner as in Example 1 except for using the modified polyethylene wax prepared in Preparation Example 10 as a lubricant.

COMPARATIVE EXAMPLE 8

A developer was prepared in the same manner as in Example 1 except for using the modified polyethylene wax prepared in Preparation Example 11 as a lubricant.

The physical properties of the lubricants used in Examples 1 to 4 and Comparative Examples 1 to 6 are shown in Table 1 below.

The developers prepared in Examples and Comparative Examples were evaluated in accordance with the following test methods and standards of evaluation. The results obtained are shown in Table 2 below.

1) Offset Temperature

A copying test was carried out using a fixing unit Vivace 550 (modified) manufactured by Fuji Xerox Co., Ltd. The heated roll temperature was stepwise increased from 180° C. up to 250° C. by 5° C., and the temperature at which offset was observed visually was read. In Table 2, "no occurrence" means that offset did not occur at 250° C.

2) Temperature Causing no Scratches by Peeling claw (Non-scratch Temperature)

A copying test was carried out using a fixing unit Vivace 550 (modified) manufactured by Fuji Xerox Co., Ltd. at a varied heated roll temperature, and the scratches appearing on the front edge portion of a solid toner image due to the peeling claw were observed. The temperature at which the observed scratches were on a practically acceptable level was read. In Table 2, "no occurrence" means that no scratch was observed at the lowest testing temperature of 140° C.

3) Rub-off Resistance

A test was carried out using an automatic original feed system of Vivace 550 (modified) manufactured by Fuji Xerox Co., Ltd. Five originals were set in the system and fed. The stains on the back side of the second to fifth originals was observed visually and graded as follows.

G0 . . . No back side stains was observed.

G2 . . . Back side stains hardly perceptible were visually observed.

G2 . . . Back side stains perceptible were visually observed.

G3 . . . Back side stains clearly noticeable were visually observed.

Grades G0 and G1 are levels acceptable for practical use.

4) Storage Stability

The developer was allowed to stand at 50° C. and 50% RH for 17 hours and then sifted through a vibratory screen having an opening size of 63 μm for 5 minutes to examine anti-blocking properties.

G1 . . . The 63 μm screen pass ratio was 70% or more.

G2 . . . The 63 μm screen pass ratio was 40% or more and less than 70%.

G3 . . . the 63 μm screen pass ratio was less than 40%.

5) The amount of the toner transfer

The toner particles before adding a hydrophobic colloidal silica externally thereto in each Example and Comparative Example had been maintained at a condition of 40° C./50% RH for 8 hours. Then, the amount of the toner transfer per minute by a toner box Vivace 800 (modified) was measured.

TABLE 1

| | Starting Wax | | | Grafting Material | | | | Modified Wax | |
|---|---|---|---|---|---|---|---|---|---|
| | | | Melt | | | | | Melt | Hexane |
| Example No. | Kind | Mw/Mn | Viscosity* (cP) | Kind | Graft Ratio (part by weight) | Kind | Graft Ratio (part by weight) | Viscosity* (cP) | Extraction (%) |
| Example 1 | Polyethylene | 1.30 | 12.0 | styrene | 25 | — | — | 28.5 | 62.5 |
| Example 2 | " | 1.20 | 7.7 | " | 25 | — | — | 17.0 | 63.0 |
| Example 3 | " | 1.30 | 12.0 | " | 12.5 | dibutyl fumarate | 12.5 | 20.5 | 58.5 |
| Example 4 | " | 1.30 | 12.0 | " | 12.5 | butyl methacrylate | 12.5 | 20.0 | 55.5 |
| Example 5 | " | 1.12 | 12.0 | " | 25 | — | — | 23.7 | 61.5 |
| Compara. Example 1 | " | 2.60 | 85.0 | — | — | — | — | — | 45.0 |
| Compara. Example 2 | Polypropylene | 2.80 | 70.0 | — | — | — | — | — | 48.0 |
| Compara. Example 3 | Polyethylene | 2.20 | 10.0 | styrene | 25 | — | — | 22.0 | 70.0 |
| Compara. Example 4 | " | 1.30 | 12.0 | " | 2 | — | — | 12.0 | 58.0 |
| Compara. Example 5 | " | 1.30 | 12.0 | " | 12.5 | dibutyl fumarate | 54 | 130 | 65.0 |
| Compara. Example 6 | Polypropylene | 2.80 | 70.0 | " | 25 | — | — | 250 | 75.0 |
| Compara. Example 7 | Polyethylene | 1.37 | 10.0 | " | 25 | — | — | 22.0 | 67.0 |
| Compara. Example 8 | " | 1.37 | 10.0 | " | 12.5 | dibutyl fumarate | 12.5 | 16.0 | 71.5 |

TABLE 2

| Example No. | Offset Temperature (° C.) | Non-scratch Temperature (° C.) | Rub-off Resistance | Storage Stability | Toner Transfer (g/min) |
|---|---|---|---|---|---|
| Example 1 | no occurrence | no occurrence | G0 | G1 | 1.5 |
| Example 2 | no occurrence | no occurrence | G0 | G1 | 1.7 |
| Example 3 | no occurrence | no occurrence | G1 | G1 | 1.6 |

TABLE 2-continued

| Example No. | Offset Temperature (° C.) | Non-scratch Temperature (° C.) | Rub-off Resistance | Storage Stability | Toner Transfer (g/min) |
|---|---|---|---|---|---|
| Example 4 | no occurrence | no occurrence | G0 | G1 | 1.8 |
| Example 5 | no occurrence | no occurrence | G0 | G1 | 1.8 |
| Compara. Example 1 | 219 | 159 | G0 | G3 | 0.3 |
| Compara. Example 2 | no occurrence | 165 | G3 | G2 | 0.2 |
| Compara. Example 3 | 220 | 168 | G1 | G2 | 0.9 |
| Compara. Example 4 | 232 | 155 | G0 | G3 | 0.3 |
| Compara. Example 5 | 208 | 145 | G2 | G3 | 0.6 |
| Compara. Example 6 | 229 | 153 | G3 | G2 | 1.0 |
| Compara. Example 7 | 218 | 149 | G2 | G3 | 0.3 |
| Compara. Example 8 | 224 | 144 | G3 | G3 | 0.2 |

As has been fully described and demonstrated, the toner for developing electrostatic latent images according to the present invention essentially comprises a binder resin, a colorant, and a lubricant, in which the lubricant is a modified polyethylene wax obtained by graft-modifying an ethylene homopolymer or a copolymer comprising ethylene and an α-olefin having 3 to 10 carbon atoms which is obtained by polymerization in the presence of a metallocene catalyst with a styrene monomer and/or an unsaturated carboxylic acid monomer, the lubricant having a hexane extraction of not more than 65% by weight. The toner of the present invention has satisfactory anti-offset properties, excellent powder fluidity, undergoes no blocking phenomenon under high temperature and high humidity, and provides a toner image resistant against scratches by a peeling claw of a fixing roll part and against rub-off.

While the invention has been described in detail and with reference to specific examples thereof, it will be apparent to one skilled in the art that various changes and modifications can be made therein without departing from the spirit and scope thereof.

What is claimed is:

1. A toner for developing electrostatic latent images comprising a binder resin, a colorant, and a lubricant, wherein said lubricant comprises a modified polyethylene wax which is obtained by homopolymerizing ethylene or copolymerizing ethylene and an α-olefin having 3 to 10 carbon atoms in the presence of a metallocene catalyst and modifying the resulting ethylene homo- or copolymer by grafting thereto at least one grafting monomer selected from the group consisting of a styrene monomer and an unsaturated carboxylic acid monomer such that the modified polyethylene wax contains 5 to 30 parts by weight of said grafting monomer to 100 parts by weight of the ethylene homo- or copolymer, said lubricant having a hexane extraction of not more than 65% by weight.

2. A toner according to claim 1, wherein said lubricant has a melt viscosity of 15 to 250 cP at 160° C.

3. A toner according to claim 1, wherein said ethylene homo- or copolymer has an intrinsic viscosity of not more than 0.4 dl/g.

4. A toner according to claim 3, wherein said ethylene homo- or copolymer has an intrinsic viscosity of 0.005 to 0.35 dl/g.

5. A toner according to claim 1, wherein said ethylene homo- or copolymer has a weight average molecular weight to number average molecular weight ratio (Mw/Mn) of 1.05 to 1.3.

6. A toner according to claim 1, wherein said lubricant is present in an amount of 1 to 20% by weight based on the weight of the toner.

* * * * *